US006999691B2

(12) United States Patent
Lee

(10) Patent No.: US 6,999,691 B2
(45) Date of Patent: Feb. 14, 2006

(54) DEVELOPING DEVICE HAVING VARIABLE BIAS VOLTAGES APPLIED THERETO USED WITH ELECTROPHOTOGRAPHIC IMAGE FORMING APPARATUS AND DEVELOPING METHOD THEREOF

(75) Inventor: Duck-hee Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 146 days.

(21) Appl. No.: 10/680,297

(22) Filed: Oct. 8, 2003

(65) Prior Publication Data

US 2004/0136741 A1 Jul. 15, 2004

(30) Foreign Application Priority Data

Jan. 10, 2003 (KR) ..... 10-2003-0001605

(51) Int. Cl.
*G03G 15/08* (2006.01)

(52) U.S. Cl. ..... 399/55; 399/281; 399/283; 399/285

(58) Field of Classification Search ..... 399/55, 399/281, 283, 285
See application file for complete search history.

(56) References Cited

U.S. PATENT DOCUMENTS 6,067,427 A * 5/2000 Shin ..... 399/281
6,327,451 B1 * 12/2001 Mizuno ..... 399/281
6,353,720 B1 * 3/2002 Sakai et al. ..... 399/281
6,684,047 B1 * 1/2004 Kin et al. ..... 399/285

FOREIGN PATENT DOCUMENTS

JP 2001-142285 5/2001

OTHER PUBLICATIONS

Notice to submit Response and Office Action of Korean Intellectual Property Office.

* cited by examiner

*Primary Examiner*—William J. Royer
(74) *Attorney, Agent, or Firm*—Stanzione & Kim, LLP

(57) ABSTRACT

A developing device used with an electrophotographic image forming apparatus and developing method thereof includes a power supplying unit which applies a first electric field to a toner transfer body and a supplying member so that the toner is supplied to the toner transfer body when a development operation is performed, and applies a second electric field to the toner transfer body and the supplying member so that the toner is removed from the toner transfer body when the development operation is not performed, by varying a developing bias and a supplying bias.

18 Claims, 3 Drawing Sheets

DEVELOPING DEVICE HAVING VARIABLE BIAS VOLTAGES APPLIED THERETO USED WITH ELECTROPHOTOGRAPHIC IMAGE FORMING APPARATUS AND DEVELOPING METHOD THEREOF

CROSS-REFERENCE TO RELATED APPLICATIONS

This application claims the priority of Korean Patent Application No. 2003-1605, filed on Jan. 10, 2003, in the Korean Intellectual Property Office, the disclosure of which is incorporated herein in its entirety by reference.

BACKGROUND OF THE INVENTION

1. Field of the Invention

The present invention relates to an electrophotographic image forming apparatus, and more particularly, to a developing device used with an electrophotographic image forming apparatus, which supplies a developing agent to a photosensitive body and develops the photosensitive body, and a developing method thereof.

2. Description of the Related Art

In general, electrophotographic image forming apparatuses form an electrostatic latent image which corresponds to a desired image by radiating light on a photosensitive body, form a toner image by supplying toner to the electrostatic latent image, transfer the toner image onto a recording medium, and fuse the toner image on the recording medium, thereby printing an image.

FIG. 1 is a cross-sectional view schematically illustrating a conventional electrophotographic image forming apparatus. Referring to FIG. 1, the conventional electrophotographic image forming apparatus includes a photosensitive body 1, a charging roller 2, an exposure unit 3, a developing unit 4, a transfer roller 9, and a cleaning unit 11.

The charging roller 2 supplies a charge to a surface of the photosensitive body 1 and charges the surface of the photosensitive body 1 at a predetermined electric potential. The exposure unit 3 radiates light corresponding to image information on the photosensitive body 1. Then, an electrostatic latent image is formed by a difference in electric potential between a first portion on which the light is irradiated and a second portion on which the light is not irradiated. The developing unit 4 forms a toner image by supplying toner to the electrostatic latent image.

The developing unit 4 includes a developing roller 5 which is spaced—apart from the photosensitive body 1 by a predetermined gap, a supplying roller 6 which supplies the toner to the developing roller 5, and a layer regulation member 7 which regulates a thickness of the toner attached to a surface of the developing roller 5.

A developing electric field Vd is applied to the developing roller 5 so as to supply the toner to the electrostatic latent image formed on the photosensitive body 1. The developing roller 5 is rotated in a direction opposite to the photosensitive body 1. That is, outer circumferences of the photosensitive body 1 and the developing roller 5 progress in the same direction at a developing nip where the photosensitive body 1 and the developing roller 5 face each other.

The supplying roller 6 is rotated while contacting the developing roller 5. The supplying roller 6 is rotated in the same direction as the developing roller 5. That is, outer circumferences of the developing roller 5 and the supplying roller 6 progress in different directions at a contact portion between the supplying roller 6 and the developing roller 5.

A supply electric field Vs is applied to the supplying roller 6 so as to attach the toner to the developing roller 5.

The layer regulation member 7 contacts the outer circumference of the developing roller 5 while applying a predetermined pressure thereto. The layer regulation member 7 regulates the toner attached to the outer circumference of the developing roller 5 so as to have a predetermined thickness, and simultaneously rubs against the toner, thereby charging the toner.

The toner image is transferred onto a sheet of paper passing through a space where the transfer roller 9 and the photosensitive body 1 are located. Reference numeral 12 denotes a fusing unit which fuses the toner image onto the paper by applying heat and pressure to the paper passing along a path 13. The cleaning unit 11 removes the toner remaining on the surface of the photosensitive body 1 after a transfer operation.

According to the above structure, the developing electric field Vd and the supply electric field Vs are applied to the developing roller 5 and the supplying roller 6, respectively, during a printing operation so that the toner can be attached to the developing roller 5.

The toner remaining on the surface of the developing roller 5 after the developing roller 5 has developed the electrostatic latent image on the photosensitive drum 1, is partially detached from the surface of the developing roller 5 by friction with the supplying roller 6. And, the toner remaining on the surface of the developing roller 5 may be stuck onto the surface of the developing roller 5 while passing through a space between the developing roller 5 and the supplying roller 6 repeatedly. In particular, when the remaining toner passes through a space between the developing roller 5 and the layer regulation member 7 repeatedly, a frictional heat accumulates to increase a temperature thereof so that the toner may be fused onto the layer regulation member 7. In order to obtain a uniform image concentration, a thin and uniform toner layer should be formed on the outer circumference of the developing roller 5. However, if the toner is stuck onto the surface of the developing roller 5 and/or the layer regulation member 7 as described above, the uniform toner layer cannot be formed. In addition, if the remaining toner passes through the space between the developing roller 5 and the layer regulation member 7 repeatedly and rubs against the layer regulation member 7 to increase a charging amount, new toner is prevented from being supplied to the developing roller 5. Thus, the new toner is not sufficiently supplied to a partial region of an image, and thus, spots or stripes occur on a printed image, and an image quality is lowered.

SUMMARY OF THE INVENTION

The present invention provides a developing device used with an electrophotographic image forming apparatus having an improved structure, in which toner remaining on a surface of a developing roller is effectively removed by adjusting a developing bias and a supplying bias, and a developing method thereof.

Additional aspects and advantages of the invention will be set forth in part in the description which follows and, in part, will be obvious from the description, or may be learned by practice of the invention.

According to one aspect of the present invention, a developing device used with an electrophotographic image forming apparatus includes a toner transfer body which supplies toner to an electrostatic latent image formed on a photosensitive body and develops the electrostatic latent image, a supplying member which supplies the toner to the toner transfer body, and a power supplying unit which applies a developing bias Vdr and a supplying bias Vsr, formed by overlapping DC on AC, to the toner transfer body and the supplying member, respectively. The power supplying unit applies a first electric field to the toner transfer body and the supplying member so that the toner is supplied to the toner transfer body when a development operation is performed, and applies a second electric field to the toner transfer body and the supplying member so that the toner is removed from the toner transfer body when the development operation is not performed, by varying the developing bias Vdr and the supplying bias Vsr.

According to another aspect of the present invention, a developing method performed using an electrophotographic image forming apparatus includes applying a developing bias Vdr and a supplying bias Vsr formed by overlapping DC on AC, respectively, to a toner transfer body and a supplying member to supply the toner to the toner transfer body, supplying the toner to an electrostatic latent image formed on a photosensitive body, and developing the electrostatic latent image, wherein a first electric field is applied to the toner transfer body and the supplying member so that the toner is supplied to the toner transfer body when a development operation is performed, and a second electric field is applied to the toner transfer body and the supplying member so that the toner is removed from the toner transfer body when the development operation is not performed, by varying the developing bias Vdr and the supplying bias Vsr.

According to another aspect of the present invention, the developing bias Vdr and the supplying bias Vsr have the same frequency, are synchronized with each other, and have the same duty ratio.

It is possible that, when a maximum value and a minimum value of the developing bias Vdr are Vdr max and Vdr min, respectively, and a maximum value and a minimum value of the supplying bias Vsr are Vsr max and Vsr min, respectively, and a duty ratio of a region having the same polarity as a charging polarity of the toner in the developing bias Vdr and the supplying bias Vsr is duty, the first electric field is obtained by $$|Vdr\ \min - Vsr\ \min| \times \text{duty} < |Vdr\ \max - Vsr\ \max| \times (1-\text{duty}), \text{ and}$$

the second electric field is obtained by $$|Vdr\ \min - Vsr\ \min| \times \text{duty} > |Vdr\ \max - Vsr\ \max| \times (1-\text{duty}).$$

It is also possible that when the second electric field is applied to the toner transfer body and the supplying member, an absolute value of a difference between an average DC potential Vave of the developing bias Vdr and a surface potential Vs of the photosensitive body is smaller than a threshold potential difference Vth required so that the toner is transferred from the toner transfer body to the photosensitive body.

The first and second electric fields can be obtained by adjusting a duty ratio of the developing bias Vdr and the supplying bias Vsr.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
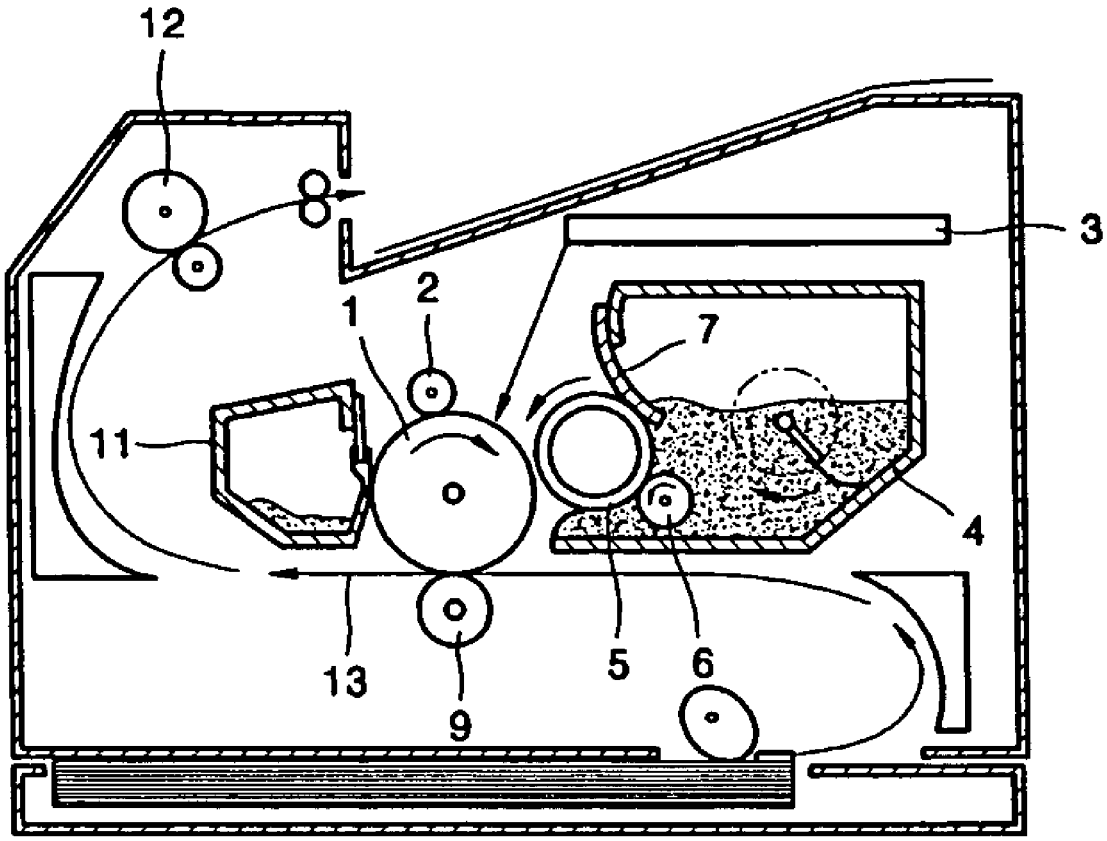
FIG. 1 (PRIOR ART)
FIG. 1 is a cross-sectional view schematically illustrating a conventional electrophotographic image forming apparatus.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
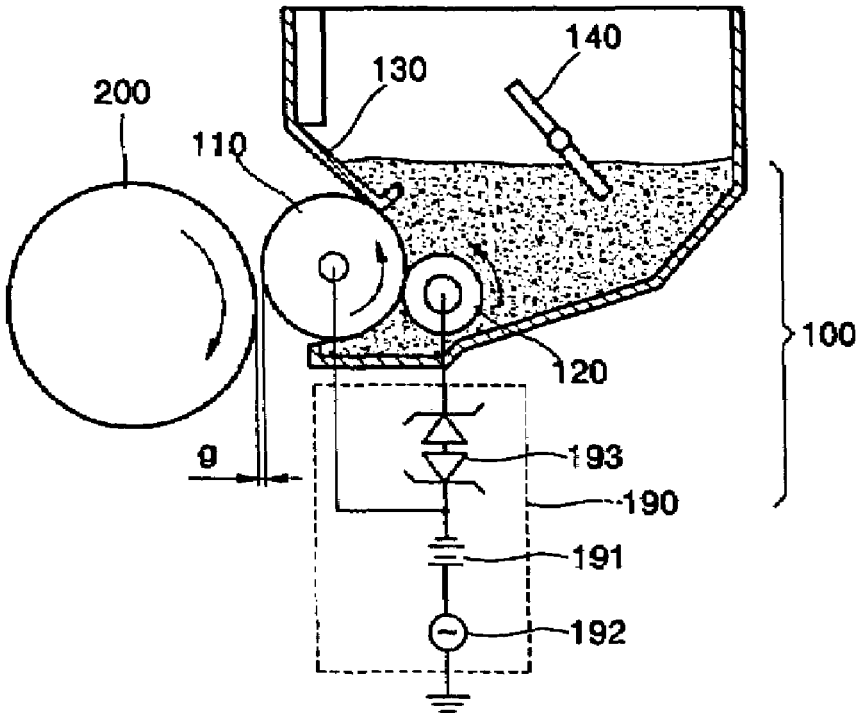
FIG. 2 is a cross-sectional view illustrating an electrophotographic image forming apparatus according to an embodiment of the present invention.

FIG. 2 is a cross-sectional view illustrating an electrophotographic image forming apparatus according to an embodiment of the present invention.

A developing unit 100 includes a toner transfer body which attaches toner to a surface of the developing unit and supplies the toner to a photosensitive body, a supplying member which supplies the toner to the toner transfer body, and a layer regulation member which regulates the toner attached to the toner transfer body to have a predetermined thickness.

Referring to FIG. 2, a developing roller 110 is shown as the toner transfer body. The developing roller 110 is spaced apart from a photosensitive drum 200, which is the photosensitive body, by a developing gap g and is rotated in an opposite direction to the photosensitive drum 200. That is, an outer circumference of the developing roller 110 and an outer circumference of the photosensitive drum 200 progress in the same direction in the vicinity of a developing nip where the photosensitive drum 200 faces the developing roller 110. The developing roller 110 may be an aluminum or rubber roller, for example. When the developing roller 110 is the aluminum roller, in particular, when an outer circumference of the developing roller 110 is nickel plated, the developing roller 110 has a surface roughness less than 3.0 $\mu$m, preferably, 1–2.5 $\mu$m. When the developing roller 110 is the rubber roller, the developing roller 110 has the surface roughness of about 3–9 $\mu$m and a resistance less than $5\times10^6$ Ω. The developing gap g may be 150–400 $\mu$m, for example.

A supplying roller 120, which is rotated while being in contact with the developing roller 110, is provided as the supplying member. The supplying roller 120 may be fabricated by covering a core made of stainless steel with a covering material such as urethane. The supplying roller 120 is rotated in the same direction as the developing roller 110. Thus, outer circumferences of the developing roller 110 and the supplying roller 120 progress in a direction opposite to each other at a portion where the developing roller 110 contacts the supplying roller 120.

A blade 130 is provided as the layer regulation member. The blade 130 contacts the outer circumference of the developing roller 110 while applying pressure of about 10–50 g/cm thereon. An elastic material, such as phosphorous bronze or stainless steel, may be used for the blade 130. The blade 130 regulates a layer thickness of the toner attached to the outer circumference of the developing roller 110 so that a uniform toner layer is formed. In addition, the blade 130 rubs against the toner to charge the toner.

The toner is a nonmagnetic one-component toner of which a coloring agent is mixed with thermal plastic resin. The toner may have an average diameter of about 8 $\mu$m, for example. The toner may be positively or negatively charged. Hereinafter, a case where the toner is negatively charged will be described.

Reference numeral 140 denotes a rotating agitator. The rotating agitator 140 transfers the toner to the supplying roller 120, and simultaneously rubs the toner onto the supplying roller 120 to charge the toner.

Figure 3:
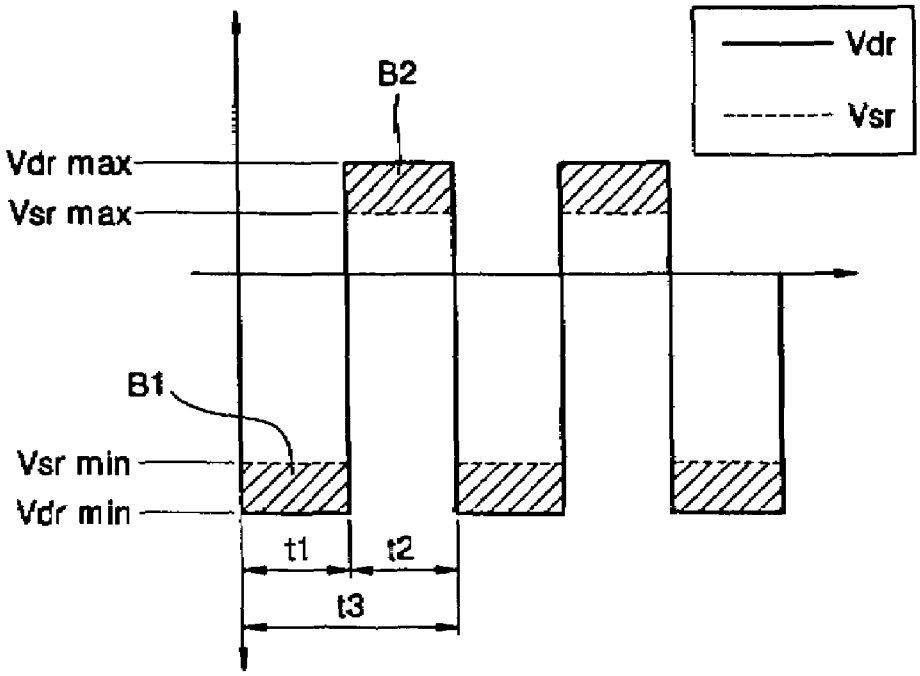
FIG. 3 is a graph schematically showing a developing bias and a supplying bias of the electrophotographic image forming apparatus shown in FIG. 2.

A power supplying unit 190 supplies a developing bias Vdr and a supplying bias Vsr to the developing roller 110 and the supplying roller 120, respectively. The developing bias Vdr and the supplying bias Vsr are formed by overlapping DC on AC, as shown in FIG. 3. Each of the developing bias Vdr and the supplying bias Vsr has the same frequency and is synchronized with each other. In addition, preferably, the developing bias Vdr and the supplying bias Vsr have the same duty ratio. The duty ratio is a ratio of a time t2 when a plus (positive) voltage is applied as the developing bias Vdr and the supplying bias Vsr, or a time t1 when a minus (negative) voltage is applied as the developing bias Vdr and the supplying bias Vsr, to one cycle time t3.

In addition, a maximum value Vdr max of the developing bias Vdr is greater than a maximum value Vsr max of the supplying bias Vsr, and a minimum value Vdr min of the developing bias Vdr is lower than a minimum value Vsr min of the supplying bias Vsr. Since the toner is negatively charged, in a region B1, the toner is attached to the supplying roller 120 having a bias potential higher than that of the developing roller 110. In contrast, in a region B2, the toner is attached to the developing roller 110 having a bias potential higher than the supplying roller 120. Thus, the region B1 is a removal electric field region where the toner is removed from the developing roller 110, and the region B2 is a supply electric field region where the toner is attached to the developing roller 110.

Figure 4:
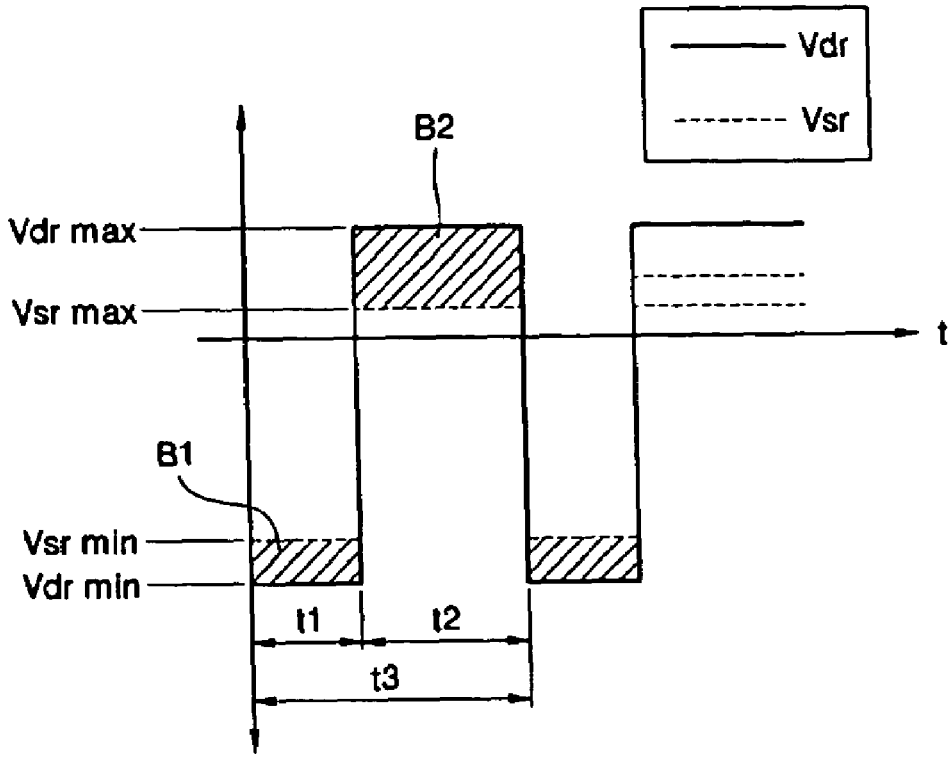
FIG. 4 is a graph showing a first electric field of the electrophotographic image forming apparatus shown in FIG. 2.
Figure 5:
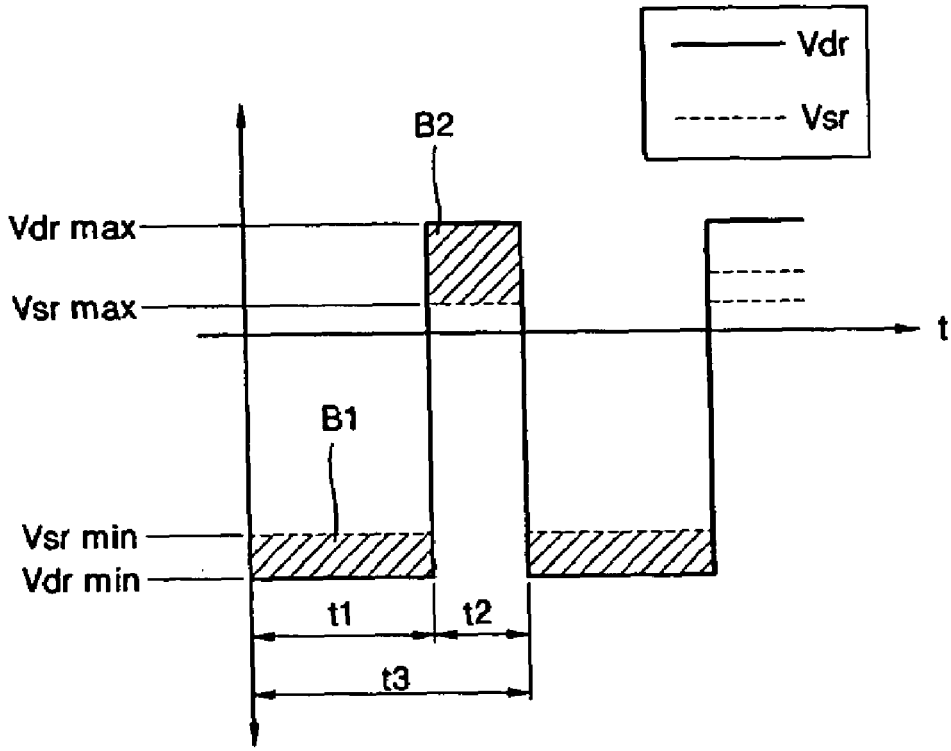
FIG. 5 is a graph showing a second electric field of the electrophotographic image forming apparatus shown in FIG. 2.

The power supplying unit 190 applies a first electric field to supply the developing roller 110 with the toner when a development operation is performed. The power supplying unit 190 applies a second electric field to remove the toner from the developing roller 110 when the development operation is not performed. FIGS. 4 and 5 are graphs each showing the first electric field and the second electric field when the toner is negatively charged.

As shown in FIG. 4, the first electric field is decided so that an area of the region B2, which is the supply electric field region, is larger than an area of the region B1, which is the removal electric field region. Then, the amount of the toner supplied to the developing roller 110 is larger than that of the toner removed from the developing roller 110. As such, the toner is supplied to the developing roller 110. The first electric field may be obtained by Equation 1.

$$|Vdr\ \mathrm{min}-Vsr\ \mathrm{min}|\times \mathrm{duty}<|Vdr\ \mathrm{max}-Vsr\ \mathrm{max}|\times(1-\mathrm{duty}) \quad (1)$$

Here, "duty" is a duty ratio of a region where a bias having the same polarity as a charging polarity of the toner is applied, i.e., a duty ratio of the region B1, and "duty"=t1/t3.

As shown in FIG. 5, the second electric field is decided so that an area of the region B1, which is the removal electric field region, is larger than an area of the region B2, which is the supply electric field region. Then, the amount of the toner removed from the developing roller 110 is larger than the amount of the toner supplied to the developing roller 110. As such, the toner is removed from the developing roller 110. The second electric field may be obtained by Equation 2.

$$|Vdr\ \mathrm{min}-Vsr\ \mathrm{min}|\times \mathrm{duty}>|Vdr\ \mathrm{max}-Vsr\ \mathrm{max}|\times(1-\mathrm{duty}) \quad (2)$$

Here, "duty" is a duty ratio of a region where a bias having the same polarity as a charging polarity of the toner is applied, i.e., a duty ratio of the region B1, and "duty"=t1/t3.

As described above, the second electric field is applied to the developing roller 110 and the supplying roller 120 so that the toner is removed from the developing roller 110 when the development operation is not performed. Thus, when the second electric field is applied to the developing roller 110 and the supplying roller 120, as shown in Equation 3, preferably, an absolute value of a difference between an average DC potential Vave of the developing bias Vdr and a surface potential Vs of the photosensitive drum 200 is smaller than a threshold potential difference Vth which is required to attach the toner to the photosensitive drum 200 from the developing roller 110. In an opposite case where the absolute value of the difference is larger than the threshold potential difference Vth, the toner is transferred from the developing roller 110 to the photosensitive drum 200. The threshold potential difference Vth increases in proportion to a developing gap.

$$Vave=Vdr\ \mathrm{max}-[(Vdr\ \mathrm{max}-Vdr\ \mathrm{min})\times \mathrm{duty}]$$

$$|Vave-Vs|<Vth \quad (3)$$

As described above, the case where the toner is negatively charged has been explained, however, Equations 1 through 3 may be applied to another case where the toner is positively charged. In this case, "duty"=t2/t3 is applied to Equations 1 through 3.

The first and second electric fields may be obtained by adjusting a duty ratio of a region where a bias having the same polarity as a charging polarity of the toner is applied, without changing the maximum and minimum values of the developing bias Vdr and the supplying bias Vsr, or by adjusting the maximum and minimum values of the developing bias Vdr and the supplying bias Vsr without changing the duty ratio of the region where the bias having the same polarity as the charging polarity of the toner is applied. In addition, the first and second electric fields may be obtained by adjusting both the duty ratio of the region and the maximum and minimum values of the developing bias Vdr and the supplying bias Vsr.

In the present embodiment, single DC and AC power supplies 191 and 192 are used as the power supplying unit 190, as shown in FIG. 2. The supply electric field Vsr is applied to the supplying member 120 via a voltage controlling member 193. Thus, in the present embodiment, the first and second electric fields that satisfy Equations 1 and 2 are obtained by adjusting only the duty ratio of the region where the bias having the same polarity as the charging polarity of the toner in the developing bias Vdr and the supplying bias Vsr is applied. For this purpose, it is possible that the AC power supply 192 that can vary the duty ratio is used.

It is also possible that the power supplying unit 190, which is a single power supplying unit, simultaneously supplies the developing bias Vdr and the supplying bias Vsr, as shown in FIG. 2. Although not shown, two separate power supplying units may be provided to supply the developing bias Vdr and the supplying bias, respectively.

Now, a developing method having the above structure will be described with reference to FIGS. 2–5.

Here, the case where the negatively charged nonmagnetic one-component toner is used, will be described.

If a printing command is given by a controlling unit (not shown), a surface of the photosensitive drum 200 is charged by a charger (not shown) at a predetermined electric potential. Next, light corresponding to image information is irradiated by an exposure unit onto the surface of the photosensitive drum 200, and thus, an electrostatic latent image is formed.

The first electric field, indicated by Equation 1, is applied to the developing roller 110 and the supplying roller 120 so that the toner is supplied to the electrostatic latent image to develop the electrostatic latent image. Then, as described above, since the amount of the toner supplied to the developing roller 110 is larger than the amount of the toner removed from the developing roller 110, the toner is supplied to the developing roller 110 to be attached thereto. In this way, the toner attached to the outer circumference of the developing roller 110 by the first electric field is charged by friction with the blade 130, and simultaneously, the thickness of the toner is regulated and supplied to the developing nip. At the developing nip, the toner is attached to the electrostatic latent image by the potential difference between the photosensitive drum 200 and the developing roller 110, and thus, the electrostatic latent image is developed.

In a case that several sheets of images are printed, if a sheet having an image is printed, there is a region where an image is not printed until a next image is printed. Even in this case, the developing roller 110 and the supplying roller 120 are continuously rotated. However, the electrostatic latent image is not formed, and thus, a development operation does not occur. In this case, the second electric field, indicated by Equation 2, is applied to the developing roller 110 and the supplying roller 120 so that the toner is removed from the developing roller 110. The supplying roller 120 progresses in the same direction as the developing roller 110. That is, the supplying roller 120 progresses in the direction opposite to the developing roller 110, i.e., at a portion where the supplying roller 120 contacts the developing roller 110. Thus, due to friction between the developing roller 110 and the supplying roller 120 and an electrostatic force generated by the second electric field, the toner attached to the developing roller 110 is detached from the developing roller 110. In this case, the second electric field is applied to the developing roller 110 and the supplying roller 120 by Equation 3.

Accordingly, a mechanical action caused by friction and an electrostatic action caused by the second electric field occur simultaneously. Thus, the toner can be effectively removed from the developing roller as compared to a conventional developing device on which only a mechanical force acts. Thus, like in the conventional developing device, while the toner passes through a space between the developing roller and the blade, frictional heat is prevented from accumulating, and the toner is prevented from being stuck to the developing roller and/or the blade, or the toner is prevented from being overcharged and from affecting a development performance. In addition, since the toner is not stuck to the developing roller and/or the blade, a life span of a developing device can be lengthened.

If the development operation restarts, new toner is supplied to the developing roller 110 by the first electric field.

Tables 1 and 2 show experimental results regarding an image quality when an image having a coverage of 2.5% is respectively printed on one sheet, two sheets, and one sheet again in a first case where the second electric field is applied to the developing roller 110 and the supplying roller 120 and in a second case where the second electric field is not applied to the developing roller 110 and the supplying roller 120, respectively.

The developing bias Vdr is formed by overlapping the DC potential of −500V on the AC potential having a frequency of 2 KHz, and a peak-to-peak voltage is 1.8V. The supplying bias Vsr is formed by overlapping the DC potential of −700V on the same AC potential as the developing bias Vdr. A toner layer formed on the developing roller 110 is 0.45–0.655 mg/cm$^2$.

TABLE 1

| | Initial stage | 2000 sheets | 4000 sheets | 6000 sheets | 8000 sheets | 10000 sheets |
|---|---|---|---|---|---|---|
| Image concentration reproducibility | ○ | ○ | ○ | ○ | ○ | ○ |
| Background contamination | ○ | ○ | ○ | ○ | Δ | Δ |
| Occurrence of stripes | ○ | ○ | ○ | ○ | ○ | ○ |
| Dot reproducibility | ○ | ○ | ○ | ○ | ○ | Δ |

TABLE 2

| | Initial stage | 2000 sheets | 4000 sheets | 6000 sheets | 8000 sheets | 10000 sheets |
|---|---|---|---|---|---|---|
| Image concentration reproducibility | ○ | ○ | ○ | ○ | ○ | ○ |
| Background contamination | ○ | ○ | ○ | Δ | x | x |
| Occurrence of stripes | ○ | ○ | ○ | Δ | Δ | x |
| Dot reproducibility | ○ | ○ | ○ | Δ | x | x |

Here, "○" represents a good quality, "x" represents a not-good quality, and "Δ" represents a state between the good quality and the not-good quality.

As shown in Tables 1 and 2, when the number of printing sheets is small, a good image quality can be obtained both in the first case where the second electric field is applied to the developing roller 110 and the supplying roller 120 and in the second case where the second electric field is not applied to the developing roller 110 and the supplying roller 120. When the number of printing sheets exceeds 6000 sheets, in the second case where the second electric field is not applied to the developing roller 110 and the supplying roller 120, as shown in Table 2, background contamination and stripes occur, and dot reproducibility is lowered. In the first case where the second electric field is applied to the developing roller 110 and the supplying roller 120, it can be seen from Table 1 that the good image quality can be obtained for up to about 10000 sheets.

As described above, in the developing device used with the electrophotographic image forming apparatus and the developing method according to the present invention, when the development operation is not performed, the toner remaining on the surface of the toner transfer body is effectively removed by an electric field and mechanical friction such that lowering of the image quality caused by the remaining toner can be prevented. In addition, the life span of the developing device can be lengthened.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A developing device used with an electrophotographic image forming apparatus having a photosensitive body, the developing device comprising:

a toner transfer body which supplies toner to the photosensitive body having an electrostatic latent image formed thereon;

a supplying member which supplies the toner to the toner transfer body; and a power supplying unit which applies a developing bias and a supplying bias formed by overlapping a DC potential on an AC potential to the toner transfer body and the supplying member, respectively and which varies the developing bias and the supplying bias simultaneously according to a first wave pattern to generate a first electric field to be applied to the toner transfer body and the supplying member to supply the toner to the toner transfer body when a development operation is performed, and varies the developing bias and the supply bias simultaneously according to a second wave pattern to generate a second electric field to be applied to the toner transfer body and the supplying member to remove the toner from the toner transfer body when the development operation is not performed.

2. The device of claim 1, wherein the developing bias and the supplying bias have the same frequency, are synchronized with each other, and have the same duty ratio.

3. The device of claim 2, wherein when a maximum value and a minimum value of the developing bias are Vdr max and Vdr min, respectively, and a maximum value and a minimum value of the supplying bias are Vsr max and Vsr min, respectively, and a duty ratio of a region having the same polarity as a charging polarity of the toner in the developing bias and the supplying bias is duty, the first electric field is obtained by $$|Vdr\ \min - Vsr\ \min| \times \text{duty} < |Vdr\ \max - Vsr\ \max| \times (1-\text{duty}).$$

4. The device of claim 2, wherein when a maximum value and a minimum value of the developing bias are Vdr max and Vdr min, respectively, and a maximum value and a minimum value of the supplying bias are Vsr max and Vsr min, respectively, and a duty ratio of a region having the same polarity as a charging polarity of the toner in the developing bias and the supplying bias is duty, the second electric field is obtained by $$|Vdr\ \min - Vsr\ \min| \times \text{duty} > |Vdr\ \max - Vsr\ \max| \times (1-\text{duty}).$$

5. The device of claim 4, wherein when the second electric field is applied to the toner transfer body and the supplying member, an absolute value of a difference between an average DC potential of the developing bias and a surface potential of the photosensitive body is smaller than a threshold potential difference which is required to transfer the toner from the toner transfer body to the photosensitive body.

6. The device of claim 2, wherein the power supplying unit adjusts the duty ratio of the developing bias and the supplying bias when forming the first and second electric fields.

7. The device of claim 2, wherein the power supplying unit adjusts each level of the developing bias and the supplying bias when forming the first and second electric fields.

8. The device of claim 1, wherein the power supplying unit varies the developing bias between a first maximum developing bias and a first minimum developing bias and simultaneously varies the supplying bias between a first maximum supplying bias less than the first maximum developing bias and a first minimum supplying bias greater than the first minimum developing bias according to the first wave pattern, and the power supplying unit varies the developing bias between a second maximum developing bias and a second minimum developing bias and simultaneously varies the supplying bias between a second maximum supplying bias less than the second maximum developing bias and a second minimum supplying bias greater than the second minimum developing bias according to the second wave pattern.

9. The device of claim 1, wherein the first wave pattern has a first duty ratio and the second wave pattern has a second duty ratio different from the first duty ratio.

10. The device of claim 9, wherein a frequency of the first wave pattern is the same as a frequency of the second wave pattern.

11. A developing method performed using an electrophotographic image forming apparatus, the developing method comprising:

applying a developing bias and a supplying bias formed by overlapping a DC potential on an AC potential, respectively, to a toner transfer body and a supplying member;

supplying toner from the supplying member to the toner transfer body by varying the developing bias and the supplying bias simultaneously according to a first wave pattern to apply a first electric field to the toner transfer body and the supplying member;

supplying the toner to an electrostatic latent image formed on a photosensitive body;

developing the electrostatic latent image; and removing the toner from the toner transfer body by varying the developing bias and the supplying bias simultaneously according to a second wave pattern to apply a second electric field to the toner transfer body and the supplying member.

12. The method of claim 11, wherein the developing bias and the supplying bias have the same frequency, are synchronized with each other, and have the same duty ratio.

13. The method of claim 12, wherein when a maximum value and a minimum value of the developing bias are Vdr max and Vdr min, respectively, and a maximum value and a minimum value of the supplying bias are Vsr max and Vsr min, respectively, and a duty ratio of a region having the same polarity as a charging polarity of the toner in the developing bias and the supplying bias is duty, the first electric field is obtained by $$|Vdr\ \min - Vsr\ \min| \times \text{duty} < |Vdr\ \max - Vsr\ \max| \times (1-\text{duty}).$$

14. The method of claim 12, wherein when a maximum value and a minimum value of the developing bias are Vdr max and Vdr min, respectively, and a maximum value and a minimum value of the supplying bias are Vsr max and Vsr min, respectively, and a duty ratio of a region having the same polarity as a charging polarity of the toner in the developing bias and the supplying bias is duty, the second electric field is obtained by $$|Vdr\ \min - Vsr\ \min| \times \text{duty} > |Vdr\ \max - Vsr\ \max| \times (1 - \text{duty}).$$

15. The method of claim 14, wherein when the second electric field is applied to the toner transfer body and the supplying member, an absolute value of a difference between an average DC potential Vave of the developing bias and a surface potential of the photosensitive body is smaller than a threshold potential difference which is required to transfer the toner from the toner transfer body to the photosensitive body.

16. The method of claim 12, wherein the first and second electric fields are obtained by adjusting a duty ratio of the developing bias and the supplying bias.

17. The method of claim 12, wherein the first and second electric fields are obtained by adjusting levels of the developing bias and the supplying bias.

18. A developing unit used with an image forming apparatus, comprising:

a toner transfer body to supply toner to a photosensitive body having a latent image formed thereon;

a supplying member to supply toner to the toner transfer body; and a power supplying unit generating a first bias between the toner transfer body and the supplying member to attach the toner to the toner transfer body, and a second bias between the toner transfer body and the supplying member to remove toner from the toner transfer body by simultaneously adjusting at least one of a duty ratio and a level of a developing bias and a supplying bias formed by overlapping a DC potential on an AC potential and supplied to the toner transfer body and the supplying member, respectively.

* * * * *